US006125767A

United States Patent [19]

Hawthorne et al.

[11] Patent Number: 6,125,767

[45] Date of Patent: Oct. 3, 2000

[54] RAILWAY TRUCK SIDEFRAME WITH REINFORCED COLUMNS

[75] Inventors: V. Terrey Hawthorne, Lisle; Charles Moehling, Arlington Heights; Brian A. Toussaint, Lisle; Ronald D. Golembiewski, Chicago, all of Ill.

[73] Assignee: AMSTED Industries Incorporated, Chicago, Ill.

[21] Appl. No.: 09/105,993

[22] Filed: Jun. 26, 1998

[51] Int. Cl.[7] ..... B61F 5/00

[52] U.S. Cl. ..... 105/206.1; 105/182.1; 105/206.2

[58] Field of Search ..... 105/182.1, 206.1, 105/206.2

[56] References Cited

U.S. PATENT DOCUMENTS

| | | | |
|---|---|---|---|
| 3,905,305 | 9/1975 | Cope | 105/182.1 |
| 4,351,242 | 9/1982 | Irwin | 105/206.1 |
| 4,363,276 | 12/1982 | Neumann | 105/206.1 |
| 5,410,968 | 5/1995 | Hawthorne et al. | 105/206.1 |
| 5,481,986 | 1/1996 | Spencer et al. | 105/206.1 |
| 5,546,869 | 8/1996 | Nassar | 105/206.1 |
| 5,718,177 | 2/1998 | Wronkiewicz et al. | 105/206.1 |
| 5,967,053 | 10/1999 | Toussaint et al. | 105/206.1 |

*Primary Examiner*—S. Joseph Morano
*Assistant Examiner*—Lars Olson
*Attorney, Agent, or Firm*—Edwards J. Brosius; F. J. Gregorczyk; Steve J. Manich

[57] ABSTRACT

The present invention provides a sideframe for use in a traditional three piece railway freight car truck comprising a pair of laterally spaced sideframes supporting a bolster extending between the sideframes. Each sideframe comprises an elongated top compression member, two diagonal compression members extending generally downwardly at acute angles from near the ends of the top compression member, and a bottom member joining the other ends of the diagonal tension members. Two column members also extend vertically between the bottom member and the top compression member. Such column members are strengthened by two ribs that extend laterally across the structure of the column member between sidewalls of the column member.

6 Claims, 3 Drawing Sheets

RAILWAY TRUCK SIDEFRAME WITH REINFORCED COLUMNS

BACKGROUND OF THE INVENTION

The present invention relates to railway freight car trucks and, more particularly, to railway freight car truck sideframes having an improved and strengthened column member.

Railway freight car trucks are usually comprised of a three piece arrangement wherein each truck includes two sideframes laterally spaced from each other. Each sideframe includes a centrally located opening formed by vertical columns. Such centrally located opening is usually referred to as the bolster opening or pocket and is adapted to receive the ends of a bolster extending laterally from and perpendicular to the sideframes. The ends of each sideframe are laterally aligned to receive an axle wheel set in what is usually termed the pedestal jaw of the sideframe.

Typical three piece railway freight car trucks are shown in U.S. Pat. Nos. 4,363,276; 4,838,174; and 5,718,177.

A typical railway freight car truck sideframe is comprised of an elongated top compression member that extends in a longitudinal direction parallel to the railway track. The sideframe also comprises two diagonally extending tension members that extend generally downwardly at an acute angle from near the ends of the top compression member. A bottom member extends longitudinally and joins the lower ends of the diagonal tension members. Column members extend generally vertically between the bottom member and the top compression member from a point near the junction of the diagonal tension members and the bottom member. Such column members form the bolster opening in the sideframe. A top portion of the bottom member of a sideframe is usually referred to as the spring seat of the sideframe as it is adapted to receive the spring group upon which the ends of the bolster are supported. The bolster extends laterally between each sideframe with the ends of the bolster extending into the bolster pockets and supported on a spring group.

It should be understood that the sideframe is an engineered structural member that is largely hollow to accomplish weight saving. It should also be understood that the sideframe is a unitary cast steel structure made in a foundry casting operation. Accordingly, it is possible to strengthen the sideframe by the addition of various supporting structures that would become part of the unitary sideframe. However, such addition of strengthening members is always balanced against the need for lighter weight freight car trucks.

From time to time, certain freight car truck designs exhibit various degrees of decreased performance when exposed to higher capacity service. For example, certain variable damped railway freight car trucks experienced cracking in their sideframe columns when utilized in 125 ton freight car service. Such freight car truck sideframes utilized in general the column support shown in U.S. Pat. No. 4,363,276 wherein a single horizontal support rib provides lateral support for the columns.

Accordingly, it is an object of the present invention to provide an improved and strengthened railway truck sideframe.

It is another object of the present invention to provide a railway truck sideframe having an improved and strengthened column structure thereby particularly providing an improved and strengthened bolster pocket.

SUMMARY OF THE INVENTION

The present invention provides an improved and strengthened column member of a railway truck sideframe. Each sideframe of a railway freight car truck is formed of a unitary cast steel structure. Each sideframe includes an elongated top compression member that extends longitudinally and parallel to the railway tracks. Two end sections each extend longitudinally from each end of the top compression member and form pedestal jaws adapted to receive the axle bearing end of the wheel sets. Two diagonal tension members extend generally downwardly from near the end of the top compression member at an acute angle to the top compression member. A bottom member extends longitudinally and joins the lower ends of the diagonal members. Two column members are longitudinally spaced from each other and extend vertically between the bottom member and top compression member. The column members form the bolster opening or pocket of each sideframe. The top surface of the bottom member is referred to as the spring seat and is adapted to receive the spring group upon which the end of the bolster is supported.

Each column is a generally structural member having a cross section comprised of the main section extending laterally across the width of the column member. Two wearplate support sections protrude longitudinally inwardly toward the bolster opening from lateral ends of the main section of the column member. Two sidewalls protrude longitudinally outwardly away from the bolster opening from lateral ends of the main section of the column member.

A first support rib is provided having a generally planar section extending laterally outwardly from the main section of the sideframe column and from joining sections of the two sidewalls. Such first support rib is usually vertically aligned approximately between wearplate bolt openings in the sideframe column. A second support rib is comprised of a generally planar section extending laterally outwardly from the main section of the sideframe column and from adjoining sections of the two sidewalls of the column member. The second support rib is spaced vertically below the first support rib, usually in alignment with the bottom of the column wearplate.

DETAILED DESCRIPTION OF THE INVENTION

Figure 1:
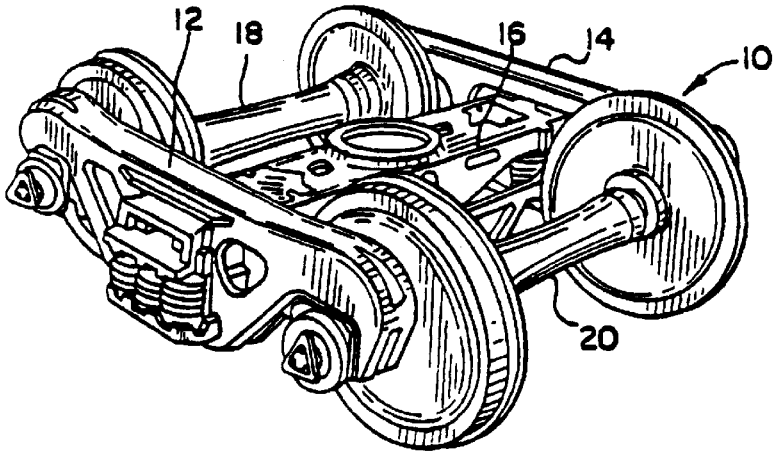
FIG. 1 is a perspective view of a railway truck comprised of two sideframes and a bolster.
Figure 2:
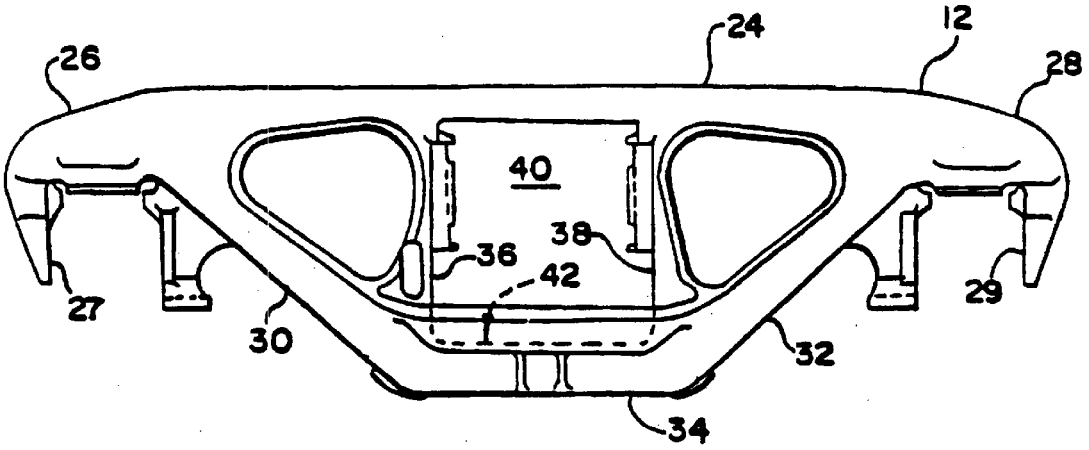
FIG. 2 is a side view of a sideframe in accordance with the present invention.

Referring now to FIGS. 1 and 2 of the drawings, a railway truck in accordance with the present invention is shown generally at 10. Railway truck 10 comprises sideframes 12 and 14 that are identical and are laterally spaced from each other. Axle wheel sets 18 and 20 are received in pedestal openings 27 and 29 formed at respective end sections 26 and 28 of each sideframe. Bolster 16 extends laterally between sideframes 12 and 14 and is received in bolster openings intermediate the pedestal ends of both sideframes. Bolster opening 40 is shown in FIG. 2 for sideframe 12.

Referring now to FIG. 2 of the drawings, sideframe 12 is comprised of a longitudinal elongated top compression member 24 that runs longitudinally across the top part of sideframe 12 and ends in end sections 26 and 28. It is seen that pedestal opening 27 is formed at a lower portion of end section 26 and pedestal opening 29 is formed at a lower portion of section 28. Diagonal tension members 30 and 32 extend downwardly from top compression member 24 at a point near end sections 26 and 28. The angle at which diagonal tension members 30 and 32 extend is about 45 degrees. Bottom section 34 extends longitudinally and joins the lower end sections of diagonal tension members 30 and 32. Column members 36 and 38 are spaced longitudinally from each other and extend vertically from an upper portion of bottom section 34 near its junction with diagonal tension members 30 and 32 to a lower surface of top compression member 24. It is seen that the combination of the lower portion of top compression member 24, the upper portion of bottom section 34 and column members 36 and 48 form a generally rectangular bolster opening 40. The upper surface of bottom section 34 is also referred to as spring seat 42.

It should be understood that sideframes 12 and 14 are unitary cast steel structures. Such structures are cast in accordance with modern foundry practice that includes the use of cores to form the structural components of sideframe 12 in a generally hollow fashion such that each structural component such as top compression member 24 and bottom section 34 are generally hollow, each comprised of a bottom section and a top section and two side sections joined to the top and bottom sections.

Figure 3:
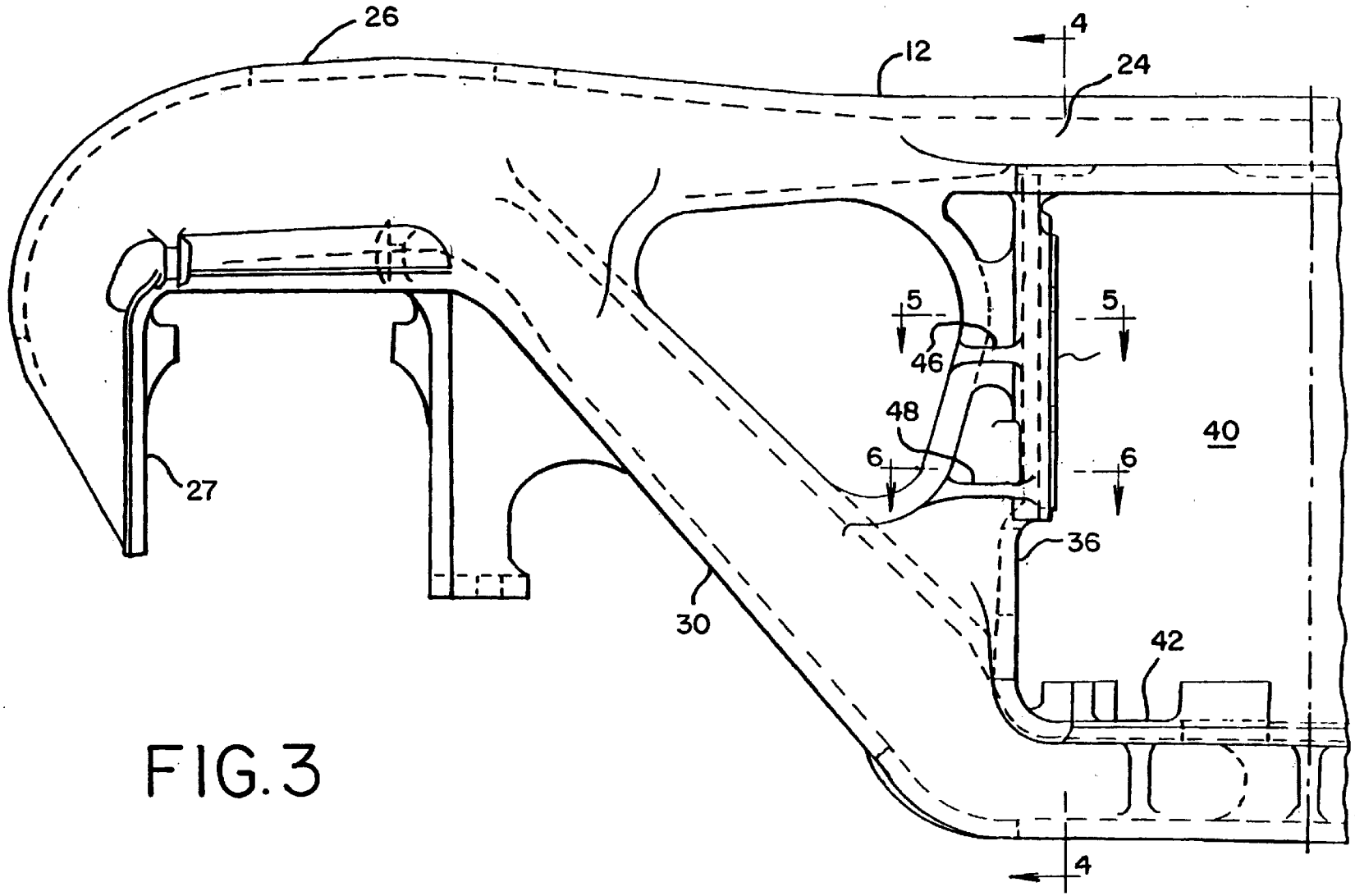
FIG. 3 is a partial side view of a sideframe in accordance with the present invention.
Figure 4:
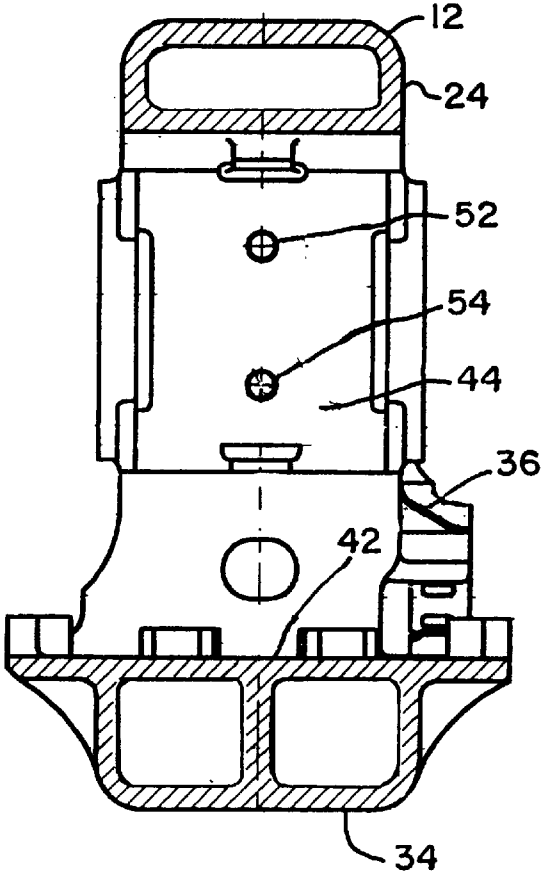
FIG. 4 is a cross sectional view of a sideframe in accordance with the present invention along lines 4—4 of FIG. 3.

Referring now to FIG. 4 of the drawings, a cross sectional view of sideframe 12 is provided along lines 4—4 from FIG. 3. Compression member 24 is seen located above bottom member 34 and spring seat 42. Top compression member 24 is seen to have a generally rectangular cross sectional structure as is bottom member 34. Spring seat 32 is seen to have certain raised locating structures for positioning springs upon which the end of bolster 16 rests. Wearplate 44 is a generally rectangular flat structure that is affixed to sideframe column 36 by bolts passing through bolt hole 52 and 54 in sideframe column 36. Wearplate 34 is adapted to abut a flat vertical surface of a friction shoe damping device that acts to dampen the oscillation of bolster 16 supported on the spring group of railway truck 10.

Figure 5:
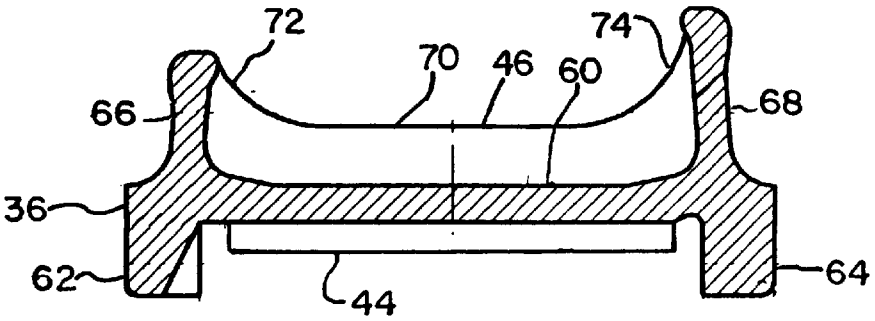
FIG. 5 is a partial cross sectional view of a portion of a sideframe column in accordance with the present invention along lines 5—5 of FIG. 3.

Referring now to FIG. 5 of the drawings, taken along line 5—5 of FIG. 3, upper support rib 46 is shown as extending longitudinally outwardly from main section 60 of column 36. Wearplate support sections 62 and 64 extend longitudinally inwardly toward bolster opening 40 from lateral ends of main section 60 of column 36. Sidewalls 66 and 68 protrude longitudinally outwardly away from bolster opening 40 from lateral ends of main section 60 of column 36. Extending laterally between sidewalls 66 and 68 is upper support rib 46. Upper support rib 46 is a unitary cast portion of sideframe 36. Upper support rib 46 is a generally flat structure having a mid-section 70 and radiused end sections 72 and 74 that extend to and join the protruding sections of sidewalls 66 and 68. Upper support rib 46 is located vertically generally between the sideframe column bolt holes 52 and 54.

Figure 6:
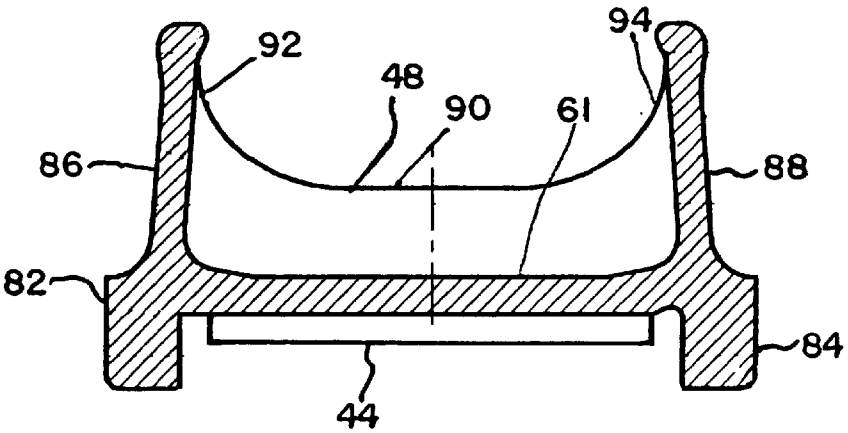
FIG. 6 is a partial cross sectional view of another portion of a sideframe column in accordance with the present invention along lines 6—6 of FIG. 3.

Referring now to FIG. 6 of the drawings, taken along line 6—6 of FIG. 3, a lower cross sectional view of sideframe column 36 is shown below the cross sectional view of FIG. 5. Such cross sectional view of column 36 shows a similar structure to that of FIG. 5, with similar wearplate support sections 82 and 84 extending longitudinally inwardly toward bolster opening 40 from lateral ends of main section 61 of sideframe column 36. Further, sidewalls 86 and 88 protrude longitudinally outwardly away from the bolster opening 40 from lateral ends of main section 61 of sideframe column 36. Lower support rib 48 is part of the unitary cast structure of sideframe column 36. Lower support rib 48 is comprised of a generally flat structure extending between sidewalls 86 and 88. Lower support rib 48 includes a mid-section 90 and radiused sections 92 and 94 each which extends to an intersection with sidewall 86 and 88, respectively. It is seen that lower support rib 48 provides additional support for sideframe column 36. This is especially necessary with the increased load carrying of today's freight car trucks wherein the bolster vertical oscillations are damped by the frictional contact of a friction shoe whose vertical face contacts wearplate 44 on sideframe column 36.

It is further understood that similar support ribs are a part of sideframe column 38 but for reasons of brevity they are not described in detail herein.

What is claimed is:

1. A sideframe for use in a railway car truck, said sideframe of a generally unitary cast steel structure comprising an elongated top compression member extending longitudinally, two end sections each extending longitudinally from an end of said top compression member and each forming a pedestal jaw, two diagonal tension members each extending at an acute angle with said top compression member from near said end of said top compression member, a bottom member extending longitudinally and joining said diagonal tension members at a lower end of each diagonal tension member, two column members longitudinally spaced from each other and extending vertically between said bottom member and said top compression member, said column members forming a bolster opening therebetween, each of said column members having a closed structural cross section comprised of a main section extending laterally across the width of said column member, two wear plate support sections each protruding longitudinally inwardly toward said bolster opening from a lateral end of said main section, and two sidewalls each protruding longitudinally outwardly from a lateral end of said main section, each of said sidewalls extending vertically for nearly the entire height of said column member, and a first support rib comprising a generally planar section extending laterally outwardly from said main section and from adjoining sections of said two sidewalls of said column member, a second support rib comprising a generally planar section extending laterally outwardly from said main section and from adjoining sections of said two sidewalls of said column member, said second support rib spaced vertically below said first support rib, two vertically aligned wear plate bolt openings in said main section of said column member, with said first support rib vertically aligned approximately between said wear plate bolt openings, and a generally rectangular, generally flat wear plate held against said main section of said column member by bolts that extend through said wear plate bolt openings, and wherein said second support rib is vertically aligned with a bottom edge of said wear plate.

2. The sideframe of claim 1 wherein said first support rib extends about 1.0 inch from said main section of said column member, and wherein said first support rib includes an inside edge that extends from each of said sidewalls at an acute angle and extends through arcuate sections to form a lateral mid-section generally parallel to said main section of said column member.

3. The sideframe of claim 1 wherein said second support rib extends about 1.5 inches from said main section of said column member, and wherein said second support rib includes an inside edge that extends from each of said sidewalls at an acute angle and extends through arcuate sections to form a lateral mid-section generally parallel to said main section of said column member.

4. A sideframe for use in a railway car truck, said sideframe of a generally unitary cast steel structure comprising an elongated top compression member, two diagonal tension members each extending generally downwardly at an acute angle from near an end of said top compression member, a bottom member joining said diagonal tension members at a lower end of each diagonal tension member, two column members extending generally vertically between said bottom member and said top compression member, said column members forming a bolster opening therebetween, each of said column members having a generally closed structural cross section, comprising a main section extending laterally, and two sidewall sections extending generally perpendicular to and outwardly from said main section, an upper support rib comprising a generally planar structure extending outwardly from said main section of said column member and from adjoining sections of said two sidewalls of said column member, a lower support rib comprising a generally planar structure extending outwardly from said main section of said column member and from adjoining sections of said two sidewalls of said column member, said lower support rib spaced vertically below said upper support rib, two vertically aligned wear plate bolt openings in said main section of said column member, with said upper support rib vertically aligned approximately between said wear plate bolt openings, and a generally rectangular, generally flat wear plate held against said main section of said column member by bolts that extend through said wear plate bolt openings, and wherein said lower support rib is vertically aligned with a bottom edge of said wear plate.

5. The sideframe of claim 4 wherein said upper support rib extends about 1.0 inch from said main section of said column member, and wherein said upper support rib includes an inside edge that extends from each of said sidewalls at an acute angle and extends through arcuate sections to form a lateral mid-section generally parallel to said main section of said column member.

6. The sideframe of claim 4 wherein said lower support rib extends about 1.5 inches from said main section of said column member, and wherein said lower support rib includes an inside edge that extends from each of said sidewalls at an acute angle and extends through arcuate sections to form a lateral mid-section generally parallel to said main section of said column member.

* * * * *